US010676684B2

(12) United States Patent
Gaughan et al.

(10) Patent No.: US 10,676,684 B2
(45) Date of Patent: Jun. 9, 2020

(54) CHARACTERIZATION OF PRE-REFINED CRUDE DISTILLATE FRACTIONS

(71) Applicant: ExxonMobil Research and Engineering Company, Annandale, NJ (US)

(72) Inventors: Roger G. Gaughan, Biltmore Lake, NC (US); Robert T. Peters, Kingwood, TX (US); Timothy D. Suter, The Woodlands, TX (US); Bryan M. Knickerbocker, Garnet Valley, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 15/181,640

(22) Filed: Jun. 14, 2016

(65) Prior Publication Data

US 2016/0319208 A1 Nov. 3, 2016

Related U.S. Application Data

(63) Continuation of application No. 14/021,028, filed on Sep. 9, 2013, now Pat. No. 9,394,497.

(51) Int. Cl.

| | |
|---|---|
| ***C10L 1/04*** | (2006.01) |
| ***C10G 7/12*** | (2006.01) |
| ***C10G 45/72*** | (2006.01) |
| ***C10G 9/00*** | (2006.01) |
| ***C10G 11/00*** | (2006.01) |

(52) U.S. Cl.

CPC ..... *C10L 1/04* (2013.01); *C10G 7/12* (2013.01); *C10G 9/00* (2013.01); *C10G 11/00* (2013.01); *C10G 45/72* (2013.01); *C10G 2300/30* (2013.01); *C10G 2300/301* (2013.01); *C10G 2400/08* (2013.01); *C10L 2200/043* (2013.01); *C10L 2270/04* (2013.01)

(58) Field of Classification Search

CPC ..... C10L 2200/043; C10L 2270/04
USPC ..... 44/300
See application file for complete search history.

(56) References Cited

U.S. PATENT DOCUMENTS

| | | | | |
|---|---|---|---|---|
| 4,280,894 | A * | 7/1981 | Taylor | C10L 1/232 208/15 |
| 4,330,302 | A * | 5/1982 | Taylor | C10L 1/232 252/401 |
| 5,000,839 | A * | 3/1991 | Kirker | B01J 29/146 208/111.01 |
| 6,846,402 | B2 * | 1/2005 | Hemighaus | C10L 1/04 208/14 |
| 7,297,963 | B2 * | 11/2007 | Moses | G01N 21/6402 250/458.1 |
| 7,692,049 | B2 * | 4/2010 | Kuechler | C10G 50/00 502/42 |
| 8,781,757 | B2 | 7/2014 | Farquharson et al. | |
| 8,822,742 | B2 * | 9/2014 | Poirier | C10G 25/02 208/209 |
| 9,035,113 | B2 * | 5/2015 | Lopez | C10G 45/44 208/15 |
| 9,169,451 | B2 * | 10/2015 | Cannella | C10G 45/68 |
| 9,394,497 | B2 * | 7/2016 | Gaughan | C10G 9/00 |
| 2005/0103686 | A1 * | 5/2005 | Taylor | C10G 25/003 208/254 R |
| 2006/0199984 | A1 * | 9/2006 | Kuechler | C10G 50/00 585/1 |
| 2007/0278133 | A1 | 12/2007 | Hemighaus et al. | |
| 2011/0005190 | A1 * | 1/2011 | Bauldreay | C10L 10/00 60/39.461 |
| 2012/0211399 | A1 | 8/2012 | Cannella et al. | |
| 2014/0229010 | A1 | 8/2014 | Farquharson et al. | |
| 2015/0041634 | A1 * | 2/2015 | Quann | G01N 33/22 250/282 |
| 2016/0047788 | A1 * | 2/2016 | Gaughan | G01N 33/22 73/64.53 |
| 2016/0047790 | A1 * | 2/2016 | Gaughan | G01N 33/2823 436/139 |

FOREIGN PATENT DOCUMENTS

WO 2006069402 A2 6/2006

OTHER PUBLICATIONS

Clark et al., "The Thermal Degradation of Aviation Fuels in Jet Engine Injector Feed-Arms: Results from a Half-Scale Rig", American Chemical Society, Aug. 31, 1990, pp. 1302-1314, XP055086998.
Pande et al., "Thermal Stability Measurement Devices Revisited: Gravimetric JFTOT Versus Simulated Test Rig", American Chemical Society, vol. 43, No. 1, pp. 89-93, Dec. 31, 1998, XP055091781.
Pande et al., Effect of Copper, MDA and Accelerated Aging on Jet Fuel Thermal Stability as Measured by the Gravimetric JFTOT, Energy & Fuels, vol. 9, No. 1, Jan. 1, 1995, pp. 177-182, XP055091825.

(Continued)

*Primary Examiner* — Ellen M McAvoy
(74) *Attorney, Agent, or Firm* — Glenn T. Barrett

(57) ABSTRACT

Methods are provided for qualifying jet fuel fractions that are derived at least in part from pre-refined crude oil sources. The methods allow for determination of the stability of a jet fuel product over time by using an accelerated aging test. The methods are beneficial for verifying the stability of a jet fuel fraction that includes a portion derived from a pre-refined crude oil.

10 Claims, No Drawings

(56) References Cited

OTHER PUBLICATIONS

Clark et al., "An Investigation of the Physical and Chemical Factors Affecting the Performance of Fuels in the JFTOT", SAE Technical Paper 881533, Oct. 1, 1988, XP008166154.
Bradley et al., "Thermal Oxidative Stability Test Methods for JPTS Jet Fuel", Fuels Branch (SFF) Air Force Aero Propulsion Laboratory Wright-Patterson AFB, Ohio, Aug. 1, 1979, XP055092067.
PCT International Search Report and Written Opinion dated Dec. 20, 2013 in corresponding PCT Application No. PCT/US2013/058848.

* cited by examiner

CHARACTERIZATION OF PRE-REFINED CRUDE DISTILLATE FRACTIONS

CROSS-REFERENCE TO RELATED APPLICATIONS

This application is a continuation of U.S. Ser. No. 14/021,028, filed Sep. 9, 2013 which claims the benefit of provisional U.S. Ser. No. 61/701,887 which is incorporated by reference herein in its entirety.

FIELD OF THE INVENTION

This invention relates to method for producing and characterizing distillate fractions derived at least in part from pre-refined crudes.

BACKGROUND OF THE INVENTION

Petroleum fractions used for jet fuel are typically qualified by an ASTM standard (ASTM D3241) to verify the suitability (ASTM D1655) of a petroleum fraction for use. Once a fraction is found to meet the specification from ASTM D1655, it is conventionally assumed that a jet fuel fraction will remain stable over time and therefore will remain within the specification limits and not need subsequent testing for requalification for use.

SUMMARY OF THE INVENTION

In an embodiment, a method is provided for preparing a jet fuel or kerosene product. The method includes determining a breakpoint for a first sample of a distillate fraction, the distillate fraction having an initial boiling point of at least about 284° F. (140° C.) and a final boiling point of about 572° F. (300° C.) or less, at least a portion of the distillate fraction being derived from a first pre-refined crude oil; maintaining a second sample of the distillate fraction at a temperature of at least about 40° C. for an aging period; determining a breakpoint for the aged second sample of the distillate fraction, the breakpoint for the aged second sample being at least about 265° C.; and preparing a jet fuel product comprising a kerosene portion derived from a second pre-refined crude oil, the second pre-refined crude oil being derived from the same source as the first pre-refined crude oil, a volume percentage of the kerosene portion derived from the second pre-refined crude in the jet fuel product being about 110% or less, such as about 100% or less, of a volume percentage corresponding to the portion of the distillate fraction derived from the first pre-refined crude oil, the initial boiling point of the jet fuel product being at least about the initial boiling point of the distillate fraction, and the final boiling point of the jet fuel product being less than or equal to the final boiling point of the distillate fraction. Preferably, the breakpoint of the aged second sample is less than 10° C. different than the breakpoint of the first sample.

In another embodiment, a method for preparing a jet fuel or kerosene product is provided. The method includes distilling a first crude oil feedstock comprising at least a first volume percentage of a first pre-refined crude oil to form a first distillate fraction having an initial boiling point of at least about 284° F. (140° C.) and a final boiling point of about 572° F. (300° C.) or less; determining a breakpoint for a first sample of the first distillate fraction; maintaining a second sample of the first distillate fraction at a temperature of at least about 40° C. for an aging period; determining a breakpoint for the aged second sample of the distillate fraction, the breakpoint for the aged second sample being at least about 265° C.; and distilling a second crude oil feedstock comprising at least a second volume percentage of a second pre-refined crude oil to form a second distillate fraction, the second pre-refined crude oil being derived from the same source as the first pre-refined crude oil, the second distillate fraction having an initial boiling point of at least about the initial boiling point of the first distillate fraction, the second distillate fraction having a final boiling point of about the final boiling of the first distillate fraction or less, wherein the second volume percentage is about 110% or less of the first volume percentage, such as about 100% or less. Preferably, the breakpoint of the aged second sample is less than 10° C. different than the breakpoint of the first sample.

DETAILED DESCRIPTION OF THE EMBODIMENTS

Overview

In various aspects, methods are provided for qualifying jet fuel fractions that are derived at least in part from pre-refined crude oil sources. The methods allow for determination of the stability of a jet fuel product over time by using an accelerated aging test. The methods are beneficial for verifying the stability of a jet fuel fraction that includes a portion derived from a pre-refined crude oil.

Kerosene or Jet Fractions from Pre-Refined Crude Sources

An increasing number of the petroleum sources being used today represent heavier and/or non-conventional sources. For some heavier crude oil sources, the oil may be difficult to remove from the ground. One way to facilitate removal of such oil is to add a diluent down well. When the diluent is pumped back into the petroleum source, flow characteristics of the oil are improved by producing a lower viscosity product. One option for generating a diluent is to remove a portion of the oil and process the portion in a coker or another type of cracking apparatus. Generating the diluent from oil removed from the well allows the diluent generation to be sustained from the oil present at a well head. A coker is typically used to generate the diluent. A petroleum crude fraction extracted by this method is sometimes referred to as a pre-refined crude, as refining processes (e.g., distillation, coking, hydrotreating, blending) have been applied to this crude before it is reblended into a pumpable oil and shipped to a refiner. These crudes are also referred to as synthetic crudes.

A pre-refined crude oil is defined herein as a crude where at least a portion of the crude oil has been cracked or otherwise converted using one or more refining processes prior to shipment of the crude to a refinery. A fraction derived from a pre-refined crude oil is defined herein as a fraction where at least 5 vol % of the fraction corresponds to molecules formed during the cracking or other conversion processes prior to shipment to a refinery. For example, at least 10 vol % of the fraction can be molecules formed during cracking or conversion prior to shipment to a refinery, or at least 25 vol % of the fraction, or at least 50 vol % of the fraction. One way to a define a molecule formed during a conversion process prior to shipment to a refinery is based on conversion of molecules relative to a boiling point. For example, molecules formed during a conversion process can be defined as molecules formed as a result of conversion of feed from a temperature above 300° C. to below 300° C., or conversion from above 350° C. to below 350° C., or conversion from above 370° C. to below 370° C., or conversion relative to any other convenient conversion temperature.

Preferably, a pre-refined crude oil can be a pre-refined crude oil that has been cracked or otherwise converted in a reaction environment containing less than 50 psig (345 kPag) of hydrogen, such as an environment containing less than 14 psig (97 kPag) of hydrogen. Such a pre-refined crude oil represents a crude oil that has not been subjected to hydroprocessing prior to shipment to a refinery. Avoiding processes that include added hydrogen is beneficial due to the costs of providing hydrogen at a well head or crude oil production site. A fraction derived from a non-hydroprocessed pre-refined crude is defined herein as a fraction where at least 5 vol % of the fraction corresponds to molecules formed during the cracking or other conversion process in a hydrogen-limited environment as described above for making a non-hydroprocessed pre-refined crude. For example, at least 10 vol % of the fraction can be molecules formed during cracking or conversion in a hydrogen-limited environment, or at least 25 vol % of the fraction, or at least 50 vol % of the fraction.

A portion of the crude oil processed in a coker (or other conversion process) to form a pre-refined crude oil will result in a pre-refined crude product fraction that boils in the kerosene boiling range, such as a fraction with an initial boiling point of at least about 284° F. (140° C.) and a final boiling point of less than about 572° F. (300° C.). An initial boiling point refers to a temperature at the instant the first drop of condensate falls from the lower end of the condenser tube in a distillation apparatus, while a final boiling point refers to a final or maximum temperature after the evaporation of all liquid from the bottom of the distillation flask. The boiling range of this material is suitable for incorporation into a jet fuel fraction. However, the composition of the kerosene boiling range material in a fraction derived from a pre-refined crude oil differs from the composition of a virgin kerosene fraction. In a conventional crude oil, the kerosene fraction of the crude typically contains only a few types of heteroatoms and/or functional groups. For example, a conventional kerosene fraction may contain sulfur, nitrogen, and olefins. Such a conventional kerosene fraction is relatively stable over time if stored at standard temperature and pressure.

By contrast, a kerosene boiling range fraction derived from a pre-refined crude oil is primarily composed of species generated by cracking of a heavier boiling range fraction. As a result, a kerosene fraction derived from a pre-refined crude oil may contain heteroatoms and/or functional groups not present in a conventional kerosene fraction. For example, due to the cracking or other conversion in a hydrogen-limited environment used to form some types of pre-refined crude oils, the kerosene fraction from a pre-refined crude can contain elevated levels of functional groups with lower stability, such as terminal olefins or alkynes. The heteroatoms present in the kerosene fraction of a pre-refined crude may also be different in character. In a conventional crude oil, for example, a large percentage of the sulfur content of a kerosene fraction may be in the form of mercaptans or other molecules where the sulfur is incorporated into a molecule by a carbon-sulfur single bond. By contrast, the portion the kerosene fraction of a pre-refined crude oil can contain a greater variety of sulfur atom types, such as sulfur atoms incorporated into di-benzothiophenes or other aromatic sulfur compounds. For example, incomplete cracking of the original crude may result in compounds where sulfur is incorporated with linkages other than carbon-sulfur single bonds.

In the discussion herein, references to a "breakpoint" are references to a JFTOT™ type breakpoint as defined by ASTM D3241. (JFTOT refers to a jet fuel thermal oxidation test defined in ASTM D3241. JFTOT is currently a registered trademark of Petroleum Analyzer Company.) Such a breakpoint is often determined with regard to a specification, such as the specification provided in ASTM D1655. Similarly, references to a "breakpoint stability" are references to a JFTOT™ breakpoint stability, as understood with reference to ASTM D3241 and/or ASTM D1655.

One side effect from the increased variety of species in a kerosene fraction derived from a pre-refined crude is that the kerosene fraction can have unsatisfactory breakpoint stability over time. This may be due to individual contaminants being more reactive, or the increased variety of functional groups and heteroatoms present in kerosene derived from a pre-refined crude may interact with each other to produce a more highly reactive environment. Regardless of the cause, the decreased breakpoint stability of a kerosene fraction derived from a pre-refined crude oil means that the properties of such a kerosene fraction are likely to have a greater variability over time as compared to a conventional kerosene fraction. In some aspects, a kerosene fraction having an unsatisfactory breakpoint stability over time can correspond to a kerosene fraction where the breakpoint changes by more than 10° C. after 1 year of storage and/or under conditions that simulate a year of storage at standard temperature of about 20° C. Alternatively, a kerosene fraction having an unsatisfactory breakpoint stability can correspond to a kerosene fraction where the breakpoint changes by more than 6° C. after 6 months of storage and/or under conditions that simulate 6 months of storage.

The lower breakpoint stability of kerosene fractions derived from pre-refined crude oils poses difficulties for the use of such kerosene fractions in jet fuel applications. Jet fuel products are typically qualified, with regard to thermal stability, using an ASTM standard test (ASTM D3241) to determine if the product properties satisfy the thermal stability specifications in ASTM D1655. The ASTM D3241 test is a "pass/fail" type test, meaning that a proposed jet fuel fraction is either qualified or not qualified for use. For jet fuel fractions formed from conventional crudes, such a "pass/fail" stability test works well as low boiling distillate fractions from conventional crudes (such as fractions suitable for use as a jet fuel product) have good breakpoint stability over time. For the fractions with uncertain breakpoint stability that are typically generated from pre-refined crudes, however, the single pass/fail breakpoint stability test does not provide information about whether a proposed jet fuel fraction will remain viable after a period of storage.

Sample Selection and Similarity of Pre-Refined Crude Sources

As an initial step for performing a stability test, a composition is selected for the sample that will be tested. Suitable samples will include at least a portion of a pre-refined crude oil from a given crude source.

Typically, the pre-refined crude oil in a sample for testing will be from a single crude source, such as pre-refined crude oils generated from a single field and/or single upgrading facility. It is well understood that the composition of crude oils and the degree of upgrading can vary widely depending on the origin of the crude. As a result, pre-refined crude oils from different sources (as well as distillate fractions derived from pre-refined crude oils from different sources) are difficult to compare. This means that stability testing for a sample containing a portion derived from a pre-refined crude oil will typically be applicable only for other samples containing material derived from pre-refined crude oils from the same source and treated by the same upgrader.

One variation on the above is that a blend of pre-refined crude oils from a plurality of sources can be tested for stability. In other words, a particular blend of pre-refined crudes can be viewed as another "source" of pre-refined crude oil and tested for stability using the methods described herein. A blend of pre-refined crude oils can be identified as equivalent to another blend of pre-refined crudes based on the ratios of pre-refined crudes within each blend. If the ratio of each pair of pre-refined crude oils within a blend is within 5% between the two blends, and if no single pre-refined crude has a greater volume percentage in the new blend than the corresponding volume percentage in the previously tested blend, the two blends can be considered equivalent. For example, in a sample of a distillate fraction containing a blend of material derived from 4 pre-refined crudes, there are six unique ratios that define the relative amounts of the pre-refined crudes in comparison to each other. A seventh ratio defines the amount of material derived from conventional crude oil relative to the amount of material derived from all pre-refined crude oils. In this example, the first blend of pre-refined crude oils corresponds to a blend or "source" that has already been characterized via stability testing and is approved for use. The second blend represents an untested blend. For two blends to be considered equivalent, each of the six pre-refined crude ratios in the first blend would need to be within 5% of the corresponding ratio in the second blend. Optionally but preferably, the volume percentage of each of the four pre-refined crude oils in the second blend is also equal to or less than the volume percentage of the corresponding pre-refined crude in the first blend. Note that for the purpose of determining the ratio of pre-refined crude oils, any pre-refined crude portion corresponding to less than 1 vol % of a sample is assigned an amount of 1 vol % for the purpose of determining the ratios. This prevents two blends from being considered different based on de minimis amounts of pre-refined crudes, such as amounts that might enter a blend due to transport in a pipeline.

In addition to selecting samples with pre-refined crude oils from the same source, the similarity of pre-refined crudes from a source can also be characterized. Even for a pre-refined crude oil from a single source, the pre-refined crude oil can still have substantial variations in properties. One difficulty is that the characteristics of crude oil removed from a field can change over time. Another difficulty is that the upgrader used to process a pre-refined crude oil may be operated at different conditions over time. Such variations in the field characteristics and/or upgrader characteristics can cause two pre-refined crude samples from the same source to still be substantially different.

Various composition features of a sample containing material derived from a pre-refined crude oil can be tested to determine the similarity between two samples. Suitable composition features for testing include the sulfur content of samples, the olefin content or bromine number, the nitrogen content, or the carbon to hydrogen ratio of a sample. Depending on the embodiment, one or more of these composition features can be compared to determine the similarity of two pre-refined crudes from the same source. Optionally, a plurality of composition features can be compared, such as a comparison using any two of the above features, or any three of the above features, or all of the above composition features. A composition feature can be defined as similar based on the nature of the composition feature. For sulfur content or nitrogen content, a composition feature is defined as similar between two feeds (such as two pre-refined crudes) if the composition feature differs by less than 10%. For carbon to hydrogen ratio and olefin content, a composition feature is defined as similar between two feeds if the composition feature differs by less than 5%. Optionally but preferably, when a composition feature is compared between a sample that has passed breakpoint stability testing and a sample that has not been tested, the untested sample is defined as similar if the composition feature in the untested sample is equal to or less than the corresponding composition feature in the tested sample. If the untested sample has a higher value than a tested sample for sulfur content, nitrogen content, carbon to hydrogen ratio, or olefin content, the untested sample is not considered to be similar to the tested sample.

Any convenient amount of material derived from a pre-refined crude oil from a crude source can be incorporated into the sample for testing. Thus, the amount of pre-refined crude oil (i.e., material derived from a pre-refined crude oil) in a sample can be at least 5 vol % of the sample, or at least 10 vol %, or at least 25 vol %, or at least 50 vol %, or at least 75 vol %. Additionally or alternatively, the amount of pre-refined crude can be 100 vol % or less, or about 95 vol % or less of the sample, or about 90 vol % or less, or about 75 vol % or less, or about 50 vol % or less, or about 25 vol % or less. The amount of pre-refined crude oil is determined at least in part by the desired amount of pre-refined crude in a corresponding desired jet fuel product. If the properties of a kerosene fraction or jet fuel fraction derived from a pre-refined crude are suitable, a sample for testing could be entirely composed of material derived from a pre-refined crude.

As an alternative, the amount of pre-refined crude can be defined based on the vol % of pre-refined crude oil in a crude oil feedstock prior to distillation or fractionation to form a jet fuel or kerosene fraction. For example, a pre-refined crude oil feedstock and a conventional crude oil feedstock can be combined prior to fractionation of the feedstocks to form a jet fuel or kerosene boiling range fraction. The combined crude oil feedstock is then fractionated to produce the desired jet fuel or kerosene boiling range fraction. Depending on the embodiment, the amount of pre-refined crude oil in a feedstock prior to forming a jet fuel fraction or kerosene fraction can be at least 5 vol % of the feedstock, or at least 10 vol %, or at least 25 vol %, or at least 50 vol %, or at least 75 vol %. Additionally or alternatively, the amount of pre-refined crude can be about 95 vol % or less of the feedstock, or about 90 vol % or less, or about 75 vol % or less, or about 50 vol % or less, or about 25 vol % or less. In situations where weight percentage is more convenient, a suitable feedstock and/or sample can include a weight percentage corresponding to any of the above percentages, such as at least about 5 wt %, or at least about 25 wt %, or about 95 wt % or less, or about 75 wt % or less. It is noted that if the pre-refined crude oil is combined with a conventional feed prior to fractionation, the percentage of material derived from a pre-refined crude oil in the jet fuel fraction may differ from the pre-refined crude oil percentage in the feedstock delivered to fractionation. Preferably, the volume percentage of material derived from a pre-refined crude in a crude feed prior to distillation will be comparable to or more preferably greater than the amount of pre-refined crude material in a corresponding kerosene or jet fuel product that is derived from such a crude feed.

If a sample for testing comprises a portion derived from a pre-refined crude and a conventional portion, any convenient type of conventional portion can be used. The conventional portion may be from a mineral source, an approved biologically-derived source, or a combination thereof. Typical conventional portions have a boiling range corresponding to an initial boiling point of at least about 284° F. (140° C.) and a final boiling point of less than about 572° F. (300° C.). The sulfur content of a conventional jet fuel portion is 3000 wppm or less, such as about 1500 wppm or less or about 500 wppm or less. Preferably, the conventional portion satisfies the jet fuel specifications in D1655 prior to combining the conventional portion with the portion derived from a pre-refined crude.

Stability Testing for Proposed Jet Fuel Products

Jet fuel products are generally tested using breakpoint stability procedure that is defined in ASTM D3241. The test involves flowing a jet fuel sample in an elevated temperature environment over a metal heater tube under specified conditions. For example, a jet fuel sample can be passed from a reservoir over a metal heater tube at a temperature of 265° C. and at a pressure of about 500 psig (3.44 MPag). The output from the metal heater tube is then passed through a differential pressure filter. The flow rate from the reservoir is typically maintained at a constant value, such as 3.0 ml/min for a set period of time, such as 150 minutes. After the test, the deposits on the metal heater tube are evaluated for color and pattern. This establishes a "tube rating" for the test. The maximum pressure drop across the filter is also determined. A proposed jet fuel sample is deemed to pass the test if both the tube rating and pressure drop values are satisfactory.

One option is to test a jet fuel sample at a single temperature, such as 265° C., to qualify the sample for use. Another option is to determine a breakpoint for the sample. To identify a breakpoint, a series of tests are performed at temperatures that differ by an interval of 5° C. At lower temperatures, the jet fuel sample will pass the tube rating (deposits) and pressure drop tests. As the temperature is increased, a temperature interval will eventually be reached where the sample has satisfactory tube rating and pressure drop values at the temperature on the lower side of the interval while failing one or both of the tube rating and pressure drop portions of the test on the high temperature side of the interval. The lower temperature of the pair of temperatures corresponding to the interval is defined as the breakpoint for the sample. In other words, the breakpoint temperature is a temperature where any further temperature increase is likely to result in failure of the sample to pass the test defined in ASTM D3241.

The method for determining a breakpoint temperature can be expanded to provide an improved method for determining the stability of a sample containing a portion derived from a pre-refined crude. First, a breakpoint temperature can be determined for a sample of a kerosene fraction. A sample of the kerosene fraction (either the same sample, or a sample of the same kerosene fraction) is then aged for a period of time under conditions that are designed to simulate a desired storage period. The breakpoint for the aged sample is then measured again. This stability test provides an indication of the behavior of the sample over time. If the breakpoint for the aged sample is still above the temperature needed for use as a jet fuel, such as a breakpoint of 265° C. or greater, then jet fuel products with a pre-refined crude content equal to or less than the content of the aged sample are likely to be suitable for use.

Additionally or alternately, a sample may also be characterized to determine that any breakpoint degradation that occurs is within an acceptable tolerance. For example, a sample of a kerosene fraction can be tested to verify that the breakpoint of the sample is at least 275° C. A sample of the kerosene fraction can then be aged for the equivalent of a year. The breakpoint for the aged sample can then be determined. In this example, a breakpoint degradation of less than 10° C. will result in the aged sample also having a breakpoint of at least 265° C.

In various embodiments, suitable samples for stability testing correspond to samples that include at least a portion derived from a pre-refined crude. A desired percentage of a conventional (such as mineral) jet fuel boiling range product can optionally also be included in the sample for stability testing. One or more samples of the potential jet fuel product can then be tested.

One way to age a jet fuel product sample for stability testing is to store a sample at an elevated temperature, such as a temperature above 40° C. For example, storing a jet fuel product sample at a temperature of 43° C. for a week has been demonstrated to be equivalent to storing the jet fuel product sample at ambient temperature (e.g., 20° C.) for a month (see ASTM D4625). This allows for testing of the breakpoint for a sample before and after an aging period to determine the impact of aging on the properties of the sample. For example, a sample with a breakpoint of 275° C. before aging and a breakpoint of 265° C. after aging for 12 weeks at 43° C. is still suitable for use as a jet fuel, even though the breakpoint for the sample has decreased. In this situation, the breakpoint of the sample has changed by 10° C. or less during the equivalent of aging for 1 year. By contrast, a sample with a breakpoint of 280° C. before aging and a breakpoint of 265° C. after aging for 12 weeks at 43° C. may or may not be suitable for use as a jet fuel. In this example, the breakpoint of the aged sample still satisfies the ASTM D3241 breakpoint requirement. However, the degradation of the breakpoint by 15° C. during the equivalent of aging for 1 year may indicate a sample that will continue to degrade in an unacceptable manner.

More generally, sample stability can be tested by first determining a breakpoint for jet fuel product samples by increasing the testing temperature for samples of the potential product. After identifying the break point, one or more samples of the jet fuel product can be aged at a temperature above 40° C. for at least 6 weeks, such as for at least 10 weeks or at least 12 weeks. Examples of suitable testing temperatures are 43° C. as described in ASTM D4625, 65° C. as described in CRC report CA-43-98, or 95° C. as described in ASTM D2274. Preferably, the aging temperature is about 43° C. After aging, the breakpoint for an aged sample of the jet fuel product is determined again to verify that the jet fuel product sample still passes the tube rating and pressure drop tests at a sufficiently high temperature to qualify for use as a jet fuel product.

Hydrotreatment or Other Upgrading

One option for incorporating a fraction derived from a pre-refined crude into a jet fuel product is to incorporate the material derived from a pre-refined crude into the jet fuel product without any prior hydrogen and/or chemical treating at the refinery. Alternatively, it may be desirable to expose a jet fuel fraction derived from conventional and/or pre-refined sources to hydroprocessing or another type of treatment prior to testing for use as a jet fuel product. Such hydrogen and/or chemical processing (or other processing) can improve the properties of a jet fuel product, including potentially improving the breakpoint stability of a jet fuel product that contains material derived from a pre-refined crude.

One option for upgrading a jet fuel fraction is to hydroprocess the jet fuel fraction. In this discussion, hydroprocessing is a type of hydrogen treating. A wide range of hydroprocessing conditions are potentially suitable for use, as even mild hydroprocessing conditions may produce a benefit in the properties of the jet fuel fraction. During hydroprocessing, a feedstock that is partially or entirely composed of a jet fuel boiling range fraction is treated in a hydrotreatment (or other hydroprocessing) reactor that includes one or more hydrotreatment stages or beds. Optionally, the reaction conditions in the hydrotreatment stage(s) can be conditions suitable for reducing the sulfur content of the feedstream, such as conditions suitable for reducing the sulfur content of the feedstream to about 3000 wppm or less, or about 1000 wppm or less, or about 500 wppm or less. The reaction conditions can include an LHSV of 0.1 to 20.0 $hr^{-1}$, a hydrogen partial pressure from about 50 psig (0.34 MPag) to about 3000 psig (20.7 MPag), a treat gas containing at least about 50% hydrogen, and a temperature of from about 450° F. (232° C.) to about 800° F. (427° C.). Preferably, the reaction conditions include an LHSV of from about 0.3 to about 5 $hr^{-1}$, a hydrogen partial pressure from about 100 psig (0.69 MPag) to about 1000 psig (6.9 MPag), and a temperature of from about 700° F. (371° C.) to about 750° F. (399° C.).

Optionally, a hydrotreatment reactor can be used that operates at a relatively low total pressure values, such as total pressures less than about 800 psig (5.5 MPag). For example, the pressure in a stage in the hydrotreatment reactor can be at least about 200 psig (1.4 MPag), or at least about 300 psig (2.1 MPag), or at least about 400 psig (2.8 MPag), or at least about 450 psig (3.1 MPag). The pressure in a stage in the hydrotreatment reactor can be about 700 psig (4.8 MPag) or less, or about 650 psig (4.5 MPag) or less, or about 600 psig (4.1 MPa) or less.

The catalyst in a hydrotreatment stage can be a conventional hydrotreating catalyst, such as a catalyst composed of a Group VIB metal and/or a Group VIII metal on a support. Suitable metals include cobalt, nickel, molybdenum, tungsten, or combinations thereof. Preferred combinations of metals include nickel and molybdenum or nickel, cobalt, and molybdenum. Suitable supports include silica, silica-alumina, alumina, and titania.

In an embodiment, the amount of treat gas delivered to the hydrotreatment stage can be based on the consumption of hydrogen in the stage. The treat gas rate for a hydrotreatment stage can be from about two to about five times the amount of hydrogen consumed per barrel of fresh feed in the stage. A typical hydrotreatment stage can consume from about 50 SCF/B (8.4 $m^3/m^3$) to about 1000 SCF/B (168.5 $m^3/m^3$) of hydrogen, depending on various factors including the nature of the feed being hydrotreated. Thus, the treat gas rate can be from about 100 SCF/B (16.9 $m^3/m^3$) to about 5000 SCF/B (842 $m^3/m^3$). Preferably, the treat gas rate can be from about four to about five time the amount of hydrogen consumed. Note that the above treat gas rates refer to the rate of hydrogen flow. If hydrogen is delivered as part of a gas stream having less than 100% hydrogen, the treat gas rate for the overall gas stream can be proportionally higher.

Forming Jet Fuel Products Based on Aged Sample Breakpoints

After determining that a jet fuel product sample derived at least in part from a pre-refined crude has a breakpoint above 265° C. after aging, and optionally that the breakpoint has not degraded at a rate of more than 10° C. per year, jet fuel products incorporating material derived from the pre-refined crude oil can be made. A jet fuel product can be considered suitable for use if the jet fuel product has sufficient similarity to an age tested sample that satisfied the breakpoint stability test. Sufficient similarity is determined based on several factors. First, the jet fuel product should include a portion derived from the same pre-refined crude oil source as the aged sample. As noted above, a "source" can correspond to a blend of feed from several pre-refined crude oil sources. Next, if the portion derived from the pre-refined crude and/or the total sample was hydroprocessed or otherwise chemically treated, the jet fuel product should be hydrogen treated and/or chemically treated under conditions with at least a comparable severity. Additionally, one or more composition features for the portion derived from the pre-refined crude in the jet fuel product can be compared with composition features for the portion derived from pre-refined crude in the age tested sample. The volume percentage of the jet fuel product derived from the pre-refined crude source should also be comparable to or less than the volume percentage of material from the pre-refined crude source in the aged sample. The volume percentage of material from the pre-refined crude source in the jet fuel product is considered comparable to the aged sample if the jet fuel product has 110% or less of the pre-refined crude material per unit volume. For example, an aged sample containing 50 vol % of material from a pre-refined crude source has a breakpoint of 265° C. or greater, and preferably has not degraded more than 10° C. after the equivalent of storage for a year. This would allow production of a jet fuel product with 55 vol % of pre-refined crude source material or less, where 55 vol % represents 110% of the 50 vol % value in the aged sample. Optionally but preferably, the jet fuel product is considered comparable to the aged sample only if the jet fuel product 100% or less of the pre-refined crude material per unit volume.

Depending on the embodiment, the portion of a jet fuel product derived from pre-refined crude can be 110% or less of the corresponding pre-refined crude amount in an aged sample, or 100% or less, or 90% or less, or 75% or less, or 50% or less. Selecting a lower percentage for the portion of a jet fuel product derived from pre-refined crude relative to the corresponding aged sample can be beneficial for a variety of reasons. Preferably, the portion derived from pre-refined crude is 100% or less. A jet fuel product with less than 100% of the pre-refined crude amount of a corresponding aged sample is believed to have improved stability relative to the aged sample. Additionally, selecting a portion derived from pre-refined crude that is less than 100% of the corresponding amount in the aged sample can provide a variability margin, to allow for variations in the processing of the conventional jet boiling range material that is blended with the pre-refined crude material. Such variations could be due to inherent process variations in the upgrading facility, due to performing a similar type of hydroprocessing on the conventional jet boiling range material but at a different upgrader or refinery, or due to performing a different type of hydroprocessing on the conventional jet boiling range material that still achieves a specification, such as a sulfur specification.

Optionally, one or more composition features of a conventional jet fuel for blending with the jet fuel derived from pre-refined crude can also be similar to the features of the jet fuel used during age testing. One option is to characterize a conventional jet fuel for blending using the composition features described above, such as sulfur content, olefin content, nitrogen content, carbon to hydrogen ratio, or boiling range. Another option is to characterize a conventional jet fuel fraction by verifying that the conventional jet fuel fraction was subject to a treatment step of equal or greater severity than a treatment step for the conventional fraction used in the aged sample. For example, if a conventional fraction is hydrotreated prior to blending, the hydrotreatment can be at least as severe as the hydrotreatment used for the conventional portion of the aged sample.

Examples of Stability Testing and Forming Corresponding Jet Fuel Products

Example 1

The following is a proposed example of how the methods described above can be applied for identifying and creating a suitable jet fuel product. A refinery identifies a proposed jet fuel product sample for testing based on a feedstock that includes 40 vol. % of material derived from a pre-refined crude source. The balance of the feed is a first conventional feedstock. An atmospheric pipestill D is used to separate a jet fuel or kerosene boiling range fraction from the crude oil feedstock. The jet fuel or kerosene boiling range fraction is then hydrotreated in a hydrotreater at 650 psig (4.5 MPag) and a conventional hydrotreating temperature.

The hydrotreated fraction is then used to generate samples for stability testing (i.e., determining breakpoints before and after aging of the samples). Determining a breakpoint for the sample before aging verifies that the initial sample meets a desired specification, such as the specification in ASTM D1655. Optionally but preferably, the breakpoint of the sample before aging is at least 275° C. A sample is then aged by storing the sample at a temperature of about 43° C. for 12 weeks to simulate aging at room temperature for a year. The breakpoint is then determined again to verify that the aged sample has a breakpoint of 265° C. or greater and/or that the breakpoint has degraded less than 10° C. during the aging.

After long term breakpoint stability has been demonstrated using the above procedure, the refinery produces commercial jet fuel based on one or more of several options. One option is to produce a jet fuel product from a crude oil feedstock containing the pre-refined crude by using pipestill D to generate a kerosene fraction with a boiling range similar to the age tested sample, followed by hydrotreatment in the same hydrotreatment reactor at a pressure of at least 650 psig (4.5 MPag) as described above. The amount of material derived from pre-refined crude in the crude feedstock can be 44 vol % or less, as this corresponds to 110% or less of the pre-refined crude portion in the tested samples. Preferably, the pre-refined crude portion can be 40 vol % or less (corresponding to 100% or less of the pre-refined crude portion in the tested samples), such as 20 vol % or less. In this option, the conventional portion of the feedstock prior to fractionation is generally similar to the conventional feedstock portion used during stability testing. The similarity of the conventional portions is determined by any convenient method, such as by comparing at least one composition feature selected from sulfur content, olefin content, nitrogen content, or carbon to hydrogen ratio.

A second option for the refinery is to produce commercial jet fuel from a feedstock containing the pre-refined crude, where the crude oil feedstock is fractionated via another atmospheric tower E. The amount of material derived from pre-refined crude in the crude oil feedstock can be 44 vol % or less, as this corresponds to 110% or less of the pre-refined crude portion in the tested samples. Preferably, the pre-refined crude derived portion can be 40 vol % or less, such as 20 vol % or less. In this option, the distilled jet fuel fraction can have a boiling point range that is within the boiling point range for the fraction generated on pipestill D. Additionally, the resulting jet fuel fraction is also processed using the hydrotreater under hydrotreatment conditions including a pressure of at least about 650 psig (4.5 MPag). The conventional crude portion of the feedstock should also be similar to the conventional portion of the aged sample, as described above.

Example 2

The following is a proposed example of how the methods described above can be applied for identifying and creating a suitable jet fuel product. A refinery identifies a desired jet fuel product based on a crude oil feedstock that is at least partially derived from a pre-refined crude. The crude oil feedstock is fractionated in an atmospheric pipestill M to form a jet fuel fraction. After fractionation, the portion of the jet fuel fraction derived from the pre-refined crude is 70 vol %. Breakpoint stability testing is performed on samples from the jet fuel fraction generated by pipestill M without any additional processing, such as additional hydrogen or chemical treating. The breakpoints before and after aging confirm that the samples from the jet fuel fraction are suitable for use as a jet fuel product.

The refinery then produces a commercial jet fuel. The crude oil feedstock is selected so that the jet fuel product after fractionation includes 110% or less of material derived from the pre-refined crude. Thus, the jet fuel product after fractionation includes 77 vol % of material derived from pre-refined crude or less. Preferably, the crude oil feedstock is selected so that the jet fuel product after fractionation includes 100% or less of material derived from the pre-refined crude. Thus, the jet fuel product after fractionation includes 70 vol % or less, such as 35 vol % or less. Preferably, the fractionation is performed using the pipestill M and the conventional crude in the feedstock is similar to the crude in the samples that were age tested. Additional processing (such as hydroprocessing or other hydrogen or chemical treating) of the jet fuel product after fractionation is not required. However, additional processing can be performed on the jet fuel product if desired.

Example 3

The following is a proposed example of how the methods described above can be applied for identifying and creating a suitable jet fuel product. A jet distillation cut from a pre-refined crude after subsequent hydrogen or chemical treating meets all ASTM D1655 specifications. The pre-refined crude derived sample is split to generate samples for stability testing. After aging at a temperature above 40° C., such as preferably 43° C., for at least 6 weeks, the samples have a breakpoint of less than 265° C. A kerosene feedstock derived from the pre-refined crude is then hydrotreated at 200 psig (1.4 MPag), 580° F. (304° C.), and 0.9 $hr^{-1}$ LHSV using 70 vol % $H_2$ over a CoMo catalyst in a pilot plant. The effluent from this hydroprocessing is used to generate samples for stability testing. The samples meet ASTM D1655 specifications both prior to aging and after aging at the temperature above 40° C. (preferably 43° C.) for at least 6 weeks. Additionally, the difference in the breakpoint between the samples before aging and after aging is 6° C. or less. Based on the pilot plant testing, a jet fuel product is identified that incorporates at least a portion of material derived from the pre-refined crude. The jet fuel product can be based on a feedstock containing up to 50 vol % of the pre-refined crude, such as up to 25 vol % of the pre-refined crude. Higher percentages of pre-refined crude could be used, but additional testing of the resulting jet fuel product may be necessary to guard against potential variations in crude oil feed quality from the upgrader. The crude oil feedstock is then fractionated to form a jet fuel fraction. The jet fuel fraction is hydrogen or chemically treated under conditions that are at least as severe as the conditions used in the pilot plant, where severity is measured based parameters such as the pressure, catalyst, and temperatures used during treatment.

ADDITIONAL EMBODIMENTS

Embodiment 1

A method for preparing a jet fuel or kerosene product, comprising: determining a breakpoint for a first sample of a distillate fraction, the distillate fraction having an initial boiling point of at least about 284° F. (140° C.) and a final boiling point of about 572° F. (300° C.) or less, at least a portion of the distillate fraction being derived from a first pre-refined crude oil; maintaining a second sample of the distillate fraction at a temperature of at least about 40° C. for an aging period; determining a breakpoint for the aged second sample of the distillate fraction, the breakpoint for the aged second sample being at least about 265° C.; and preparing a jet fuel product comprising a kerosene portion derived from a second pre-refined crude oil, the second pre-refined crude oil being derived from the same source as the first pre-refined crude oil, a volume percentage of the kerosene portion derived from the second pre-refined crude in the jet fuel product being about 110% or less of a volume percentage corresponding to the portion of the distillate fraction derived from the first pre-refined crude oil, the initial boiling point of the jet fuel product being at least about the initial boiling point of the distillate fraction, and the final boiling point of the jet fuel product being less than or equal to the final boiling point of the distillate fraction.

Embodiment 2

The method of Embodiment 1, wherein the initial boiling point of the jet fuel product is at least about the initial boiling point of the distillate fraction, and the final boiling point of the jet fuel product is less than or equal to the final boiling point of the distillate fraction.

Embodiment 3

The method of any of the above embodiments, further comprising: obtaining a portion of the distillate fraction; and splitting the portion of the distillate fraction to form at least the first sample and the second sample.

Embodiment 4

The method of any of the above embodiments, wherein the second sample of the distillate fraction is maintained at about 43° C.

Embodiment 5

The method of any of the above embodiments, wherein preparing a jet fuel product comprises distilling a crude oil feedstock to produce a fraction corresponding to the jet fuel product.

Embodiment 6

The method of any of the above embodiments, wherein the volume percentage of the kerosene portion derived from the second pre-refined crude in the jet fuel product is about 100% or less of the volume percentage corresponding to the portion of the distillate fraction derived from the first pre-refined crude oil.

Embodiment 7

The method of any of the above embodiments, further comprising: distilling a first crude oil feedstock comprising at least a first volume percentage of the first pre-refined crude oil to form the first distillate fraction.

Embodiment 8

The method of Embodiment 7, further comprising: obtaining a portion of the first distillate fraction; and splitting the portion of the first distillate fraction to form at least the first sample and the second sample.

Embodiment 9

The method of any of the above embodiments, wherein the volume percentage of the kerosene portion derived from the second pre-refined crude in the jet fuel product is about 100% or less of the volume percentage corresponding to the portion of the distillate fraction derived from the first pre-refined crude oil.

Embodiment 10

The method of any of the above embodiments, wherein the first volume percentage of the first pre-refined crude oil in the first crude oil feedstock is about 50 vol % or less.

Embodiment 11

The method of any of the above embodiments, further comprising hydrogen treating, chemically treating, or hydrogen treating and chemically treating the jet fuel product or second distillate fraction under effective treating conditions to improve the breakpoint stability of the jet fuel product or second distillate fraction, the effective treating conditions being at least as severe as treating conditions for a hydrogen treating, chemically treating, or hydrogen treating and chemically treating of the first distillate fraction.

Embodiment 12

The method of any of the above embodiments, further comprising determining that one or more composition features of the first pre-refined crude are similar to corresponding composition features of the second pre-refined crude.

Embodiment 13

The method of any of the above embodiments, wherein the aging period is at least 6 weeks, and preferably at least 12 weeks.

Embodiment 14

The method of any of the above embodiments, wherein the second volume percentage is about 50% or less of the first volume percentage.

Embodiment 15

The method of any of the above claims, wherein the source for the first pre-refined crude oil corresponds to a first blend of a plurality of pre-refined crude oils, the second pre-refined crude oil corresponding to a blend of the same plurality of pre-refined crude oils, wherein a volume ratio in the distillate fraction or first distillate fraction for each pair of pre-refined crudes in the first blend differs from a volume ratio in the jet fuel product or second distillate fraction for the corresponding pair in the second blend by about 5% or less.

Embodiment 16

The method of Embodiment 15, wherein a volume ratio of the first pre-refined crude oil to conventional crude oil in the distillate fraction or first distillate fraction is greater than or equal to a volume ratio of the second pre-refined crude oil to conventional crude oil in the jet fuel product or second distillate fraction.

Embodiment 17

The method of any of the above embodiments, wherein the first pre-refined crude oil comprises at least about 10 vol % of molecules formed during cracking or conversion in a hydrogen-limited environment, preferably at least about 25 vol %.

Embodiment 18

The method of any of the above embodiments, wherein the breakpoint for the aged second sample is less than 10° C. lower than the breakpoint for the first sample.

What is claimed is:

1. A jet fuel product comprising:

at least a material derived from a pre-refined crude oil, wherein at least a portion of the pre-refined crude oil includes a crude oil that has been cracked or otherwise converted using at least one refining process prior to processing in a refinery in an environment containing less than 50 psig of hydrogen; wherein the material derived from a pre-refined crude oil is about 100% or less of a volume percentage of the jet fuel product;

wherein the jet fuel product has a breakpoint of at least about 265° C. after an aging period equivalent to one year of aging at about 20° C., wherein the breakpoint of at least about 265° C. after an aging period equivalent to one year of aging at about 20° C. differs 10° C. or less from a breakpoint of the jet fuel product prior to the aging period, wherein the volume percentage of the material derived from the pre-refined crude oil is less than a pre-refined crude oil content in a corresponding aging sample.

2. The jet fuel product of claim 1, wherein the material derived from a pre-refined crude has an initial boiling point of at least about 284° F. (140° C.) and a final boiling point of less than about 572° F. (300° C.).

3. The jet fuel product of claim 1, wherein the material derived from a pre-refined crude oil is about 90% or less of a volume percentage of the jet fuel product.

4. The jet fuel product of claim 1, wherein the material derived from a pre-refined crude oil is about 75% or less of a volume percentage of the jet fuel product.

5. The jet fuel product of claim 1, wherein the material derived from a pre-refined crude oil is about 55% or less of a volume percentage of the jet fuel product.

6. The jet fuel product of claim 1, wherein the material derived from a pre-refined crude oil is about 50% or less of a volume percentage of the jet fuel product.

7. The jet fuel product of claim 1, wherein the material derived from a pre-refined crude oil is hydroprocessed.

8. The jet fuel product of claim 1, wherein the jet fuel product has a sulfur content of 3000 wppm or less.

9. The jet fuel product of claim 1, wherein the jet fuel product has a sulfur content of 1500 wppm or less.

10. The jet fuel product of claim 1, wherein the jet fuel product has a sulfur content of 500 wppm or less.

* * * * *